United States Patent [19]

Rudick

[11] Patent Number: 4,846,234

[45] Date of Patent: Jul. 11, 1989

[54] MICROGRAVITY DISPENSER WITH AGITATOR, METERING DEVICE AND CUP FILLER

[75] Inventor: Arthur G. Rudick, Marietta, Ga.

[73] Assignee: The Coca-Cola Company

[21] Appl. No.: 116,236

[22] Filed: Nov. 3, 1987

[51] Int. Cl.[4] ..... B65B 3/04

[52] U.S. Cl. ..... 141/98; 141/18; 141/100; 141/369; 141/69; 222/129.1; 261/DIG. 7; 99/323.2

[58] Field of Search ..... 141/100, 104, 105, 98, 141/1, 2, 18, 37, 69, 311 R, 369, 165, 82, DIG. 1; 222/96, 386.5, 1, 129.1; 261/D7; 99/323.2, 323.3

[56] References Cited

U.S. PATENT DOCUMENTS

| | | | |
|---|---|---|---|
| 4,555,371 | 11/1985 | Jeans | 141/29 X |
| 4,629,589 | 12/1986 | Gupta et al. | 222/129.1 |
| 4,649,809 | 3/1987 | Kanezashi | 141/82 X |
| 4,703,870 | 11/1987 | Sedam | 222/129.1 X |
| 4,708,266 | 11/1987 | Rudick | 222/129.1 X |
| 4,709,734 | 12/1987 | Rudick et al. | 141/2 |
| 4,752,018 | 6/1988 | Rudick et al. | 222/95 |

*Primary Examiner*—Ernest G. Cusick

*Attorney, Agent, or Firm*—Birch, Stewart, Kolasch & Birch

[57] ABSTRACT

A microgravity dispenser system including a carbonator, metering device and cup filler for dispensing a still or carbonated beverage in the microgravity conditions of outer space.

9 Claims, 6 Drawing Sheets

MICROGRAVITY DISPENSER WITH AGITATOR, METERING DEVICE AND CUP FILLER

BACKGROUND OF THE INVENTION

The present invention is directed to a microgravity dispenser system including a carbonator, metering device, and cup filler for dispensing a still or carbonated beverage in the microgravity conditions of outer space.

It is known that under zero or microgravity conditions of outer space, that beverages cannot be dispensed from a conventional post-mix beverage dispenser into an ordinary vessel or package, and that beverages cannot be poured from a vessel directly into a consumer's mouth. They must be forced out of a supply container into smaller vessels and packages, under pressure, as well as being similarly forced directly into the mouth of the consumer or astronaut. For still beverages and water, the container filling method can be one of suction. Likewise, the astronaut can suck the liquid from a collapsible container through a straw.

Furthermore, the container utilized for dispensing a beverage must be of a collapsible volume type in order to preclude the creation of an air space or pocket within the container, the location of which cannot be controlled due to the substantially zero gravity conditions.

A method and system for filling packages of carbonated beverage pre-mix is described in copending application Ser. No. 777,316, filed on Sept. 18, 1985 now U.S. Pat. No. 4,709,734, and was developed for filling pre-mix packages in outer space which is easily operated by an astronaut.

The system and method described in that copending application can be performed and utilized on Earth before the system is launched into space. However, the system thereof was designed to fill a need wherein empty permanently counter pressured packages could be refilled with pre-mix from a master supply tank in outer space which was easily operable by the crew of astronauts. The system and method of that copending application requires the pre-mix to be maintained in solution with the $CO_2$ gas, and utilized a dip tube connected to the package to dispense the beverage from a larger supply container into a consumer-size pre-mix package. The system of Ser. No. 777,316 works quite well, However, it would be desirable to provide a sophisticated post-mix beverage type dispenser for use in the microgravity conditions of outer space for filling containers only counter pressured during filling and normally vented to the atmosphere.

Another copending application Ser. No. 049,521 filed on May 14, 1987, entitled "Microgravity Carbonator System" to Rudick et al relates to a carbonator system for use either on Earth or in the microgravity conditions of outer space. The carbonator system of that copending application is incorporated herein by reference. The "Microgravity Carbonator System" does not require a distinct liquid-gas phase separation in order to operate and includes a meter assembly which supplies carbon dioxide ($CO_2$) gas and water under pressure to a pair of carbonation holding tanks. The carbonation holding tanks retain the water and $CO_2$ gas under a sufficient pressure for a sufficient time in order to permit the creation of carbonated water. The holding tanks are alternately filled by the meter assembly and are alternately discharged to a dispensing means.

An even further type of microgravity carbonator is described in another copending application Ser. No. 049,561 filed on May 14, 1987, and issued on Sept. 14, 1988 entitled "Microgravity Carbonator" to Rudick et al. This application is also incorporated herein by reference. This application discloses a carbonator system for mixing carbon dioxide and water based on the principle, that if a specific mass of carbon dioxide is forced into a specific amount of water, the water will be carbonated to a specific level. A control system and an agitator are provided to aid in mixing the water and carbon dioxide to form this carbonated water.

The above described types of carbonators and filling systems have not heretofore been combined into one comprehensive, simple-to-operate microgravity post-mix dispenser system for use in the microgravity conditions of outer space.

SUMMARY OF THE INVENTION

Accordingly, it is a primary object of the present invention to provide a comprehensive system for dispensing either a still or carbonated beverage in the microgravity conditions of outer space.

It is another object of the present invention to provide a microgravity dispenser system for dispensing a hot or cold still or cold carbonated beverage which is easily operable by astronauts or the crew of a space ship in a quick, efficient manner.

The objects of the present invention are fulfilled by providing a microgravity dispenser system for dispensing either a carbonated or still beverage in the microgravity conditions of outer space comprising:

a container for storing a supply of syrup;

a carbon dioxide source;

a water source for introducing either hot or cold water into said dispenser system;

a microgravity carbonator connected to at least said carbon dioxide source and said cold water source for maintaining a predetermined quantity of cold water at a predetermined level of carbonation;

a metering device for advancing predetermined portions of both carbonated water and syrup to a dispensing location within said dispenser system;

a microgravity drinking cup for receiving metered quantities of either said still or carbonated beverages; and means for filling said microgravity drinking cup with a beverage.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The objects of the present invention and the attendant advantages thereof will become more readily apparent with reference to the drawings, wherein.

DETAILED DESCRIPTION OF THE DRAWINGS

Figure 1:
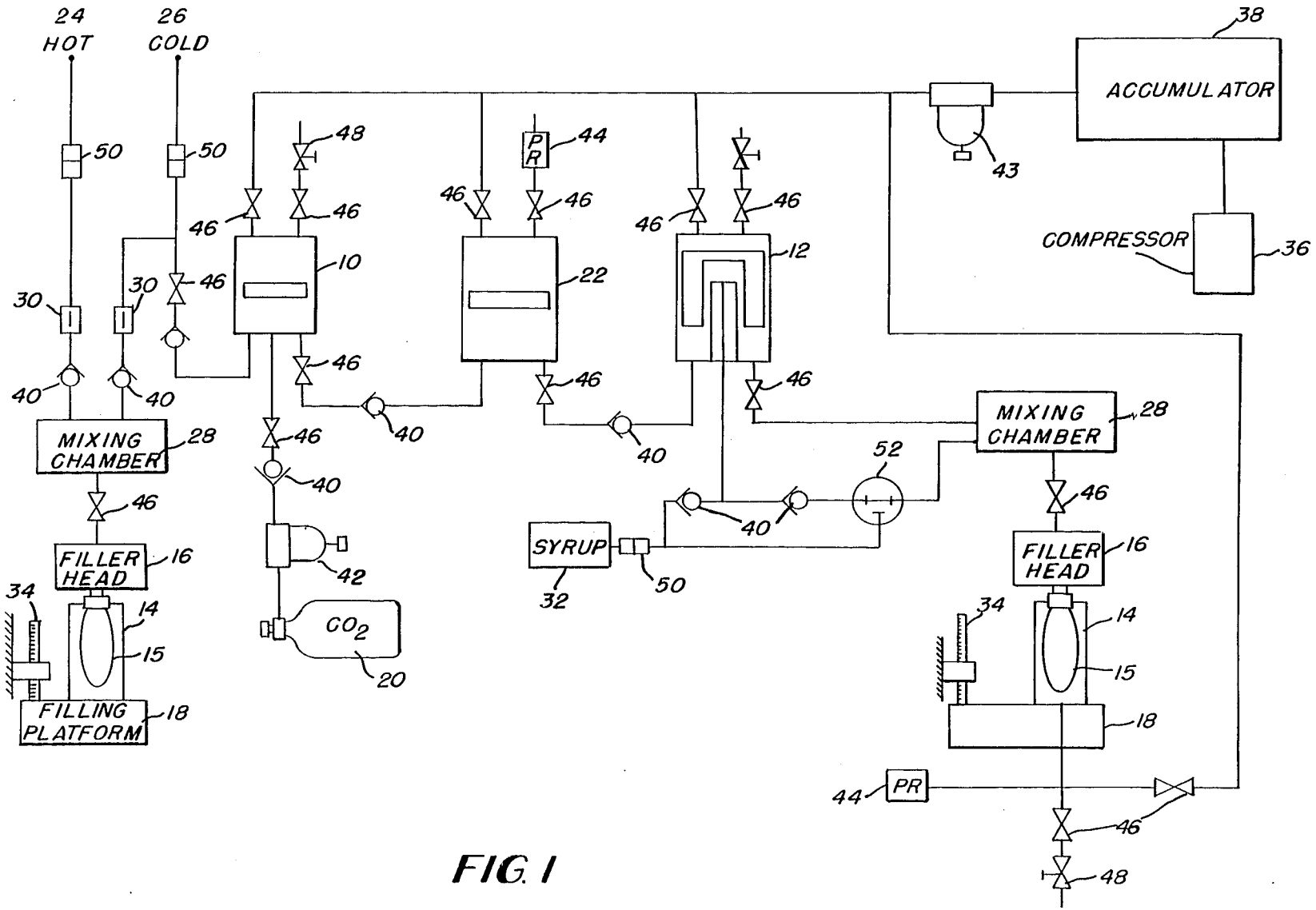
FIG. 1 is a schematic view of a microgravity dispenser system for dispensing either carbonated or still beverages in the microgravity conditions of outer space.

Referring to FIG. 1, which is a schematic view, there is illustrated a microgravity dispenser system for dispensing either carbonated or still beverages in the microgravity conditions of outer space.

In particular, there is provided a carbonator 10, a metering device 12, and at least one drinking cup 14 positioned beneath a corresponding filler head 16. The drinking cup 14 rests on a movable platform 18 such that the drinking cup 14 may be raised and lowered for engagement with the filler head 16. A linear actuator 34 is responsible for actuation of the platform 18.

A hot water source 24 and cold water source 26 are provided within the microgravity dispenser system shown for serving either a hot or cold still beverage or a cold carbonated beverage to an astronaut. The filling platform 18 is raised to engage the cup 14 with the filler head 16, in order to subsequently fill an expandable bag 15 with the desired beverage for consumption. Hot and cold still beverages can be mixed with any desired flavoring by placing a powder or liquid flavoring inside of bag 15 prior to filling.

Alternatively, the cold water source 26 may be carbonated in the carbonator 10 by a carbon dioxide ($Co_2$) source 20. The $CO_2$ source 20 enters the carbonator 10 at a predetermined pressure as controlled by pressure regulator 42, to be at 22 PSI. The carbonator will be described more fully in connection with FIGS. 2–7. The holding tank 22 can temporarily store a quantity of carbonated water at 30 PSIG for later use in the dispensing system.

The metering device 12 meters out predetermined quantities of syrup and carbonated water to achieve a satisfying and refreshing carbonated beverage.

Similar to the dispensing of still beverages, there is provided another mixing chamber 28 in which the metered quantities of carbonated water and syrup are mixed prior to filling a drinking cup 14 via the filler head 16.

Also provided in connection with the dispensing system of FIG. 1 is an accumulator 38, a compressor 36, a second pressure regulator 43 maintained at 30 PSIG, a pressure relief valve 44 for use with the drinking cup 14 in the carbonated beverage dispensing location, a plurality of ON/OFF solenoid valves 46, adjustable needle valves 48, and quick disconnect locations 50 for disengaging respective portions of the system combination. Additionally, a 3-way valve 52 enables the use of more than one syrup concentrate container for a wider carbonated beverage selection. It should be noted that for clarity, only one syrup channel is shown in the overall dispenser system of FIG. 1.

FIGS. 2–7 are schematic views of the microgravity carbonator within the dispenser of FIG. 1, and having various piston locations during the carbonation process.

Figure 3:
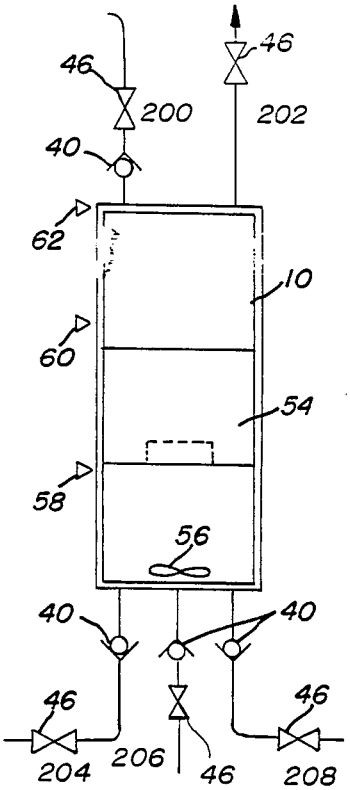
FIG. 3 is a view of the microgravity carbonator in which the piston is exactly halfway up.
Figure 4:
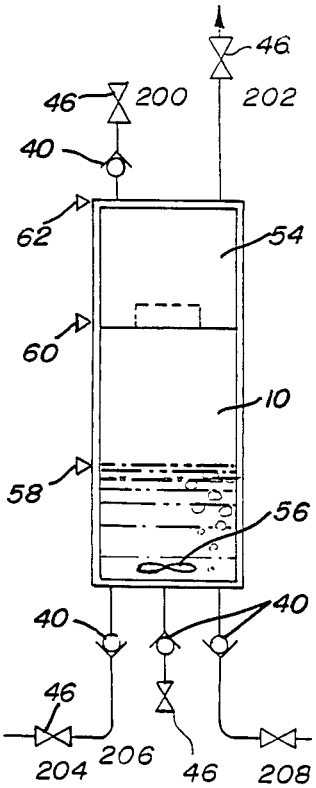
FIG. 4 is a view of the microgravity carbonator in which the piston bottoms out.
Figure 5:
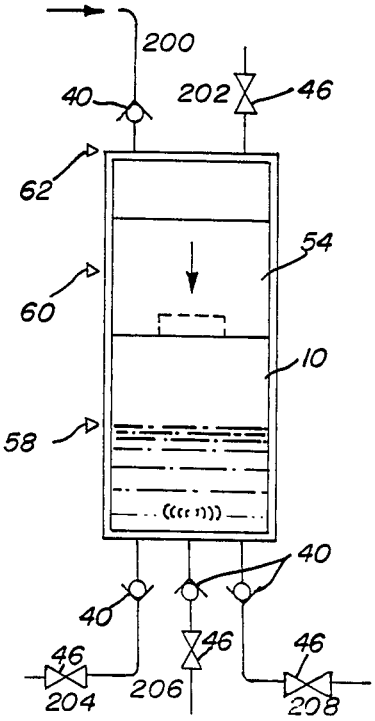
FIG. 5 is a view of the microgravity carbonator in which the piston is being forced downward.

The carbonator 10 of the present dispenser system operates on the principle that if a specific mass of $CO_2$ is forced into a specific amount of water, the water will be carbonated to a specific level. The FIGS. 2–7 referred to show how a carbonator prototype was actually tested on Earth. FIGS. 4 and 5 show a gravity induced phase separation. This type of clean separation, however, will not occur in space. A simple propeller agitator 56 is used for testing the carbonator in a gravity environment, since the agitator agitates the water to simulate the disorientation of the liquid which will occur in outer space.

Initially, it was thought that positive displacement metering pumps were needed to insure that proper amounts of $CO_2$ gas and water were fed to the carbonator. The inventors have discovered, however, that the volume of water introduced into the carbonator can be accurately controlled by passing only water into the carbonator by itself and shutting off the water flow when the piston 54 reaches the proper position as determined by low (58), intermediate (60), or high (62) position sensors. The mass of $CO_2$ gas can then be controlled by quickly introducing it into the carbonator at the proper pressure until the piston "bottoms out" or reaches the end of the piston chamber, such as shown in FIG. 4. After the piston has bottomed out and the carbonator pressure has stabilized, the $CO_2$ gas is immediately shut off. If the $CO_2$ gas is introduced quickly and without any additional agitation, the amount of gas absorbed by the water during introduction of the gas therein, will be negligible.

In operation, the carbonator 10 proceeds in the following sequence.

Figure 2:
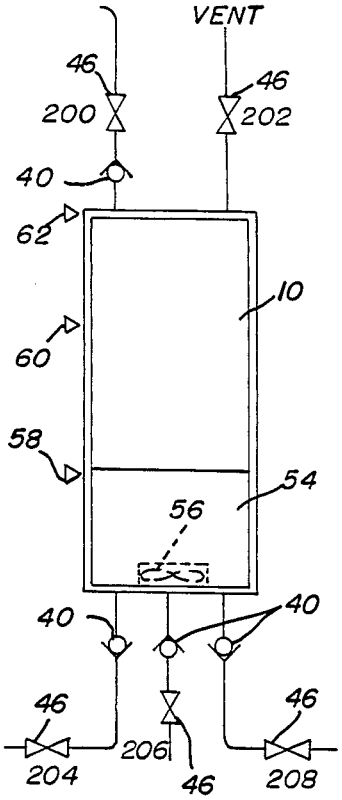
FIG. 2 is a view of a microgravity carbonator within the dispenser system of FIG. 1, in which the piston is in its initial position.

The piston 54 is initially resting on the bottom floor of the carbonator 10 as seen in FIG. 2. Vent valve 202 opens, allowing any pressurized air or $CO_2$ gas that may be above the piston 54 to escape to the atmosphere. A water valve 204 opens, allowing still water at 32° F. to enter the carbonator 10, pushing the piston 54 up. As seen in FIG. 3, when the piston 54 is exactly half way up (to position sensor 60), the carbonator 10 will contain, for example, 21 $in^3$ of still water. When the piston is located at position sensor 60, the water valve 204 shuts off.

Next, the $CO_2$ valve 208 opens to allow $CO_2$ gas at 22 PSI to enter the carbonator 10, pushing the piston 54 up further toward high position sensor 62. While the piston 54 is moving up, any gas located above the piston 54 is venting to the atmosphere through valve 2. When the piston 54 bottoms out, in addition to the still water, the carbonator will contain, for example, 21 $in^3$ of $CO_2$ gas at 22 PSIG as shown in FIG. 4.

The 22 PSIG is approximately equal to 2.5 atmospheres (absolute). Therefore, 21 $in^3$ of $CO_2$ gas at 2.5 atmospheres when dissolved into 21 $in^3$ of water causes the water to carbonate to approximately 2.5 volumes. Different levels of carbonation can be achieved by varying the pressure of the $CO_2$ gas from the suggested 22 PSIG. As soon as the piston has bottomed out and the pressure inside the carbonator has stabilized (which occurs within a few seconds of when the piston bottoms out) at 22 PSIG, valves 204 and 208 immediately shut off. At this point in time, the agitator 56 begins to agitate the solution and valve A is opened to provide a counter pressure at the top side of piston 54 to 50 PSIG. The 50 PSIG is significantly higher than the saturation pressure of 2.5 volumes of $CO_2$ in water at 32° F.

As the $CO_2$ gas is forced into solution, the piston 54 continues to move down as shown in FIG. 5, valve A stays open to insure that the system remains counter-pressurized to a level above the saturation pressure.

Figure 6:
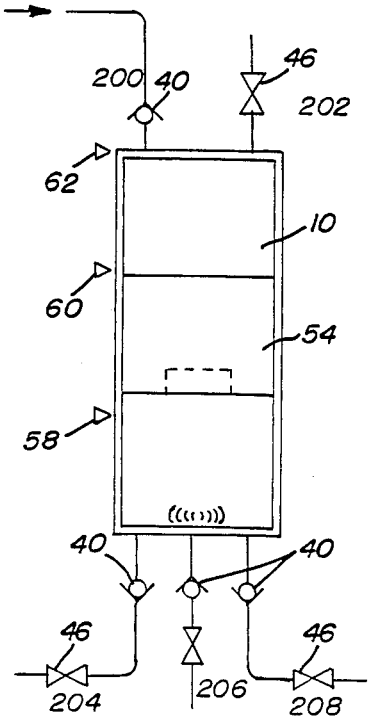
FIG. 6 is a view of the microgravity carbonator in which the piston is in the middle of its downward stroke.

When the piston 54 moves down to the middle of its stroke as marked by middle piston sensor 60, all of the $CO_2$ gas will have been forced into solution. The water is fully carbonated as shown in FIG. 6 and ready to be dispensed. The total time required for all of the $CO_2$ gas to dissolve into the water is approximately three minutes.

Figure 7:
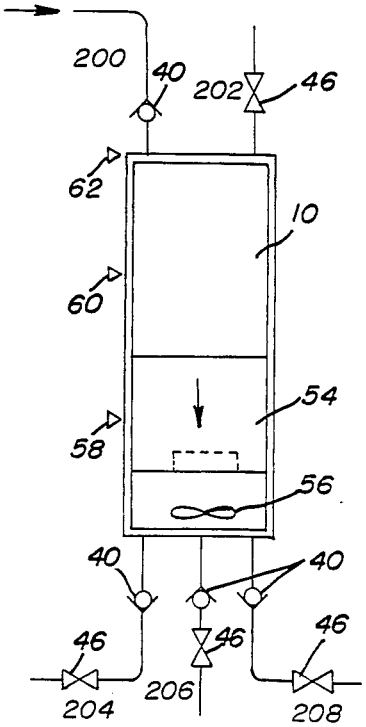
FIG. 7 is a view of the microgravity carbonator in which the piston is continually forced downward by a counter pressure on the upper surface of the piston.

When all of the $CO_2$ has been forced into solution, the agitator 56 stops agitating. To start dispensing the carbonated water, valve 206 is opened. As the carbonated water is dispensed, the piston 54 is forced down by the counter pressure which is maintained on top of the piston 54 throughout the dispensing cycle as shown in FIG. 7.

When the piston bottoms out and all of the carbonated water has been dispensed, valve 200 closes and the cycle has returned to that shown in FIG. 2. The operating cycle of the carbonator can now be repeated.

It is possible for the carbonator 10 to feed a larger holding tank 22 from which drinks are drawn into the astronaut's cup 14, or two carbonators may be used in parallel (now shown). While one carbonator is carbonating the water, the parallel carbonator is dispensing carbonated water. This eliminates the approximately three minutes of waiting time during which all of the $CO_2$ gas dissolves in the water.

All the valves 200 through 208 may be operated manually or by ON/OFF solenoids 46. The position of the piston is electronically sensed at a low 58, intermediate 60, or high 62 position, and a microprocessor may be employed to control the operating sequence of the carbonator.

Figure 8:
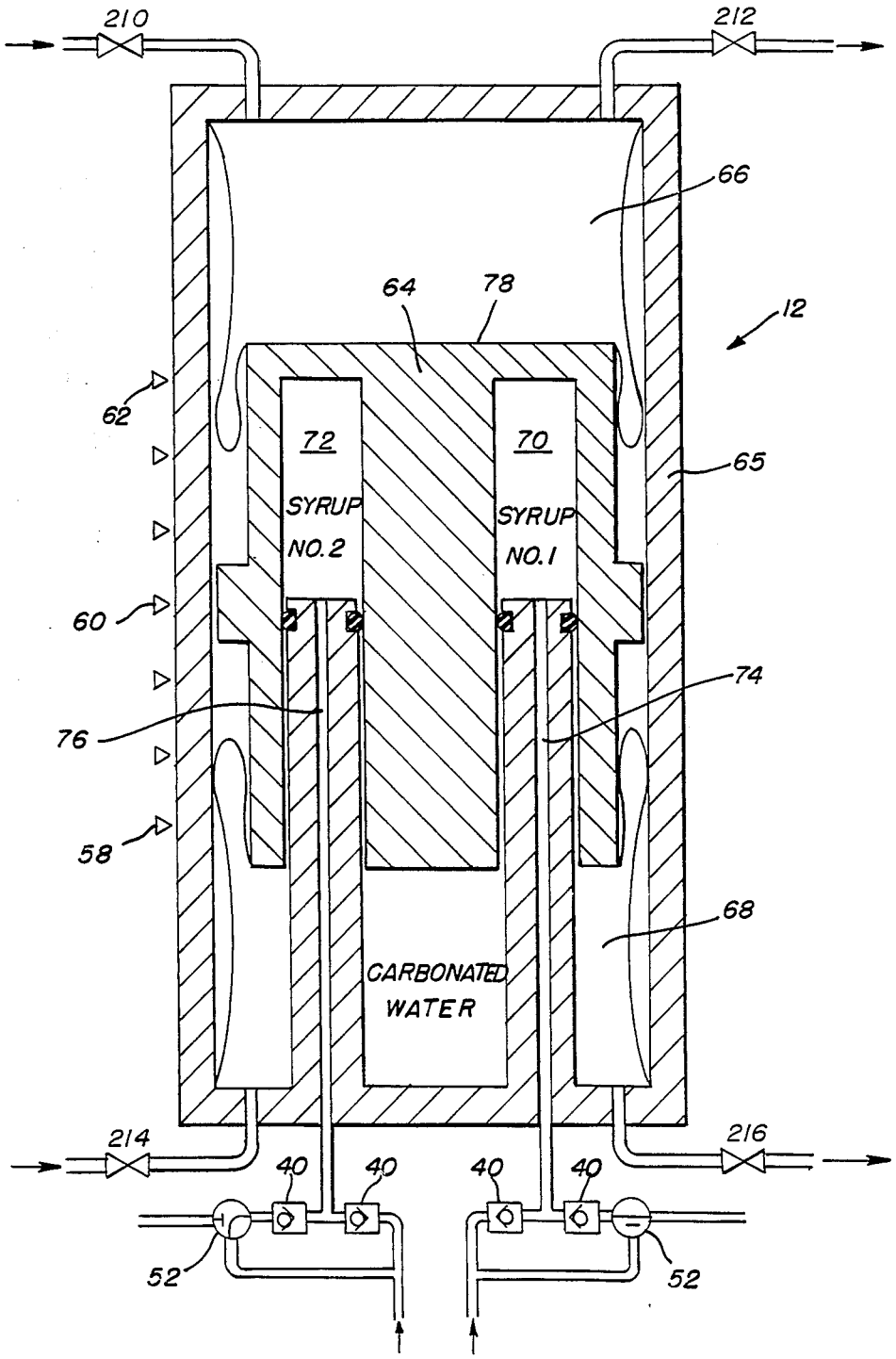
FIG. 8 is a cross-sectional view of a positive displacement metering device for use within the dispenser system of FIG. 1.

FIG. 8 is a cross-sectional view of a positive displacement metering device for use within the dispenser system of FIG. 1.

The positive displacement metering device 12 shown, has two syrup channels 74 and 76, but the system may include one or several channels.

The cycle of the metering device 12 begins with the piston 64 at its highest point within a piston cylinder 65 as defined by the walls of the metering device 12. With the piston 64 in its uppermost position, valves 210, 212, 214 and 216 are closed and both 3-way valves 52 are in a recirculate position. In the drawing of FIG. 8, the 3-way valve 52 leading to the first syrup channel 74 is shown in the dispense position. When the piston 64 is in the highest position, first and second syrup cylinders 70 and 72, respectively, are filled with syrup and the lower portion 68 of the main cylinder 65 is filled with carbonated water. A user of the microgravity dispenser system selects a desired product and an amount thereof. In the drawing of FIG. 8, a product containing syrup #1 has been selected.

In operation, an ON/OFF solenoid valve 216 opens to allow carbonated water to flow to a mixing nozzle (not shown). Valve 210 simultaneously opens to pressurize the area within an upper main cylinder 66 so that a force of 30 PSIG is pressing against the top surface 78 of the piston 64 to push the piston down, thereby keeping the carbonation in lower cylinder 68 in solution while the carbonated water is passing through valve 216 to the mixing nozzle. Also simultaneously, the 3-way valve 52 corresponding to syrup channel 74 changes to a dispense position as shown in FIG. 8.

As the main piston 64 moves downward within the piston cylinder housing 65, syrup from the first syrup Cylinder 70 is forced through syrup channel 74 (more generally referred to as syrup piston No. 1), through the 3-way valve 52 associated therewith, and onto the mixing nozzle for mixture with the metered amount of carbonate water passing through valve 216.

Syrup from the second syrup cylinder 72 is forced through channel 76 of a second syrup piston, through the 3-way valve 52 associated therewith, and back to a syrup reservoir corresponding to that syrup flavor.

The piston sensors 58, 60, and 62 detect how far the piston 64 has travelled. It can therefore be determined how much beverage has been dispensed. When the proper amount of beverage has been dispensed, valves 210 and 216 automatically shut off, and the 3-way solenoid valve 52 associated with the first syrup cylinder 70 returns to a recirculate position.

Next, valve 214 opens to allow carbonated water to enter the lower portion 68 of the main cylinder 65, forcing the main piston up. Valve 212 then opens slowly to allow gas to vent from valve 212 as the main piston 64 moves up. It is imperative that valve 212 never vent quickly enough to allow the pressure in the system to drop below the saturation pressure of the carbonated water. As the main piston 64 moves up, syrup is pulled from both syrup reservoirs into their respective syrup cylinders. When the main piston 64 reaches the top of its stroke, valves 212 and 212 close and another drink is ready do be dispensed.

Figure 9:
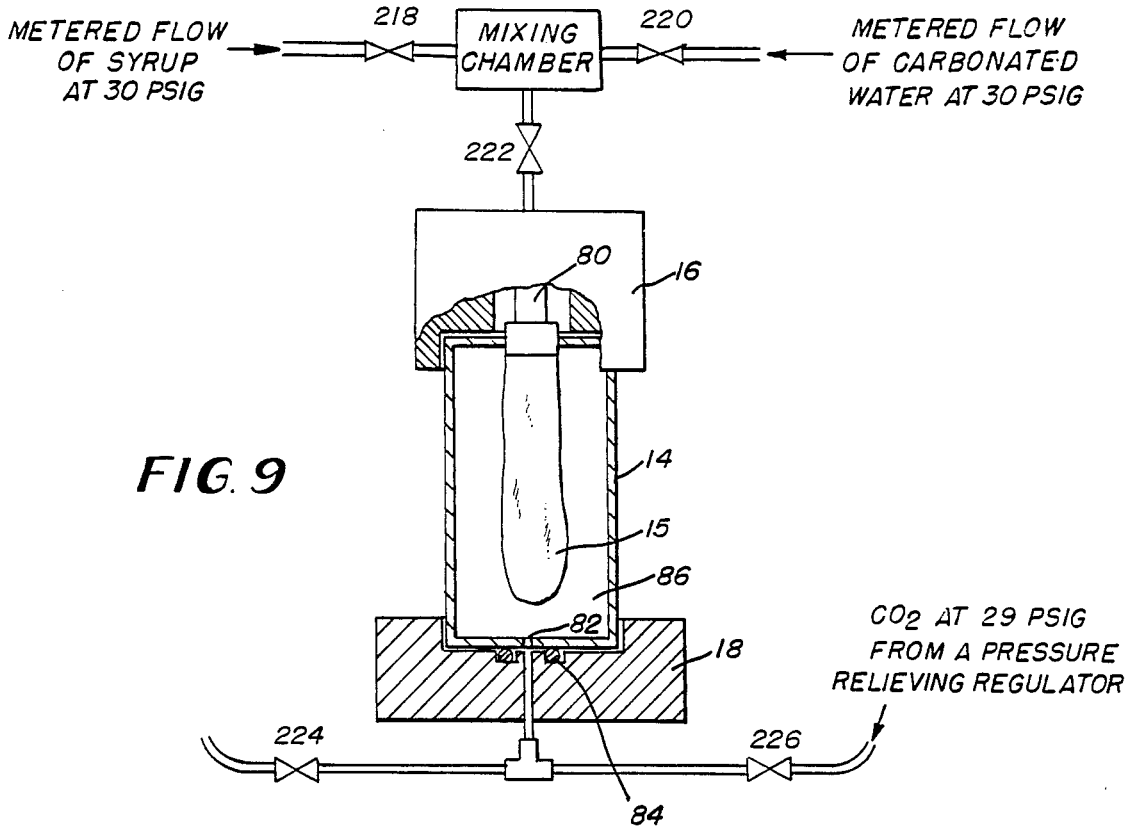
FIG. 9 is a cross-sectional view of a microgravity cup filler and drinking cup for use within the dispenser system of FIG. 1.

FIG. 9 is a cross-sectional view of a microgravity cup filler and drinking cup for use within the dispenser system of FIG. 1.

The cup 14 has a rigid outer shell and may be made of any suitable material including plastics, metal, or the like. Bladder 15 is expandable for receiving and dispensing quantities of either a still or carbonated beverage through a spout 80. A vent 82 is provided in the base of the cup 14, and the cup is designed to fit within a recess of filling platform 18. A filling head 16 engages with the spout 80 and upper portion of cup 14 to fill the expandable bag 15.

A filling cycle for the apparatus of FIG. 9 begins with the filling platform 18 down and all valves 218 through 226 closed. The astronaut or user places the cup 14 on the platform 18 and presses a product selection switch (not shown). The platform 18 raises up to engage the cup 14 and spout 80 with the filler head 16. Valve 226 opens to pressurize the interior 86 to 29 PSIG from a pressure relieving regulator through the bottom of platform 18 and through the vent 82 of the cup 14. Valves 218, 220 and 222 open to allow a post-mix beverage to gently flow into the expandable bladder 15 of cup 14 because of a one PSIG differential between the post-mix and the pressure in the cup shell 86. Because the pressure on the post-mix never drops below the saturation pressure throughout the filling operation, the carbonation of the post-mix stays in solution. When the desired amount of beverage is in the expandable bag 15 of the cup 14, valves 218, 220, 222 and 226 close. Valve 224 then slowly opens to gently vent the cup shell interior 86 to atmospheric pressure. Because the pressure is relieved gently, the carbonation of the post-mix stays in solution. When the pressure within the cup shell interior 86 has been relieved, valve 224 closes and the platform 18 lowers to its original position. It is then possible for the user to remove the cup 14 from the platform 18 for consumption of the beverage within the cup.

Figure 10A:
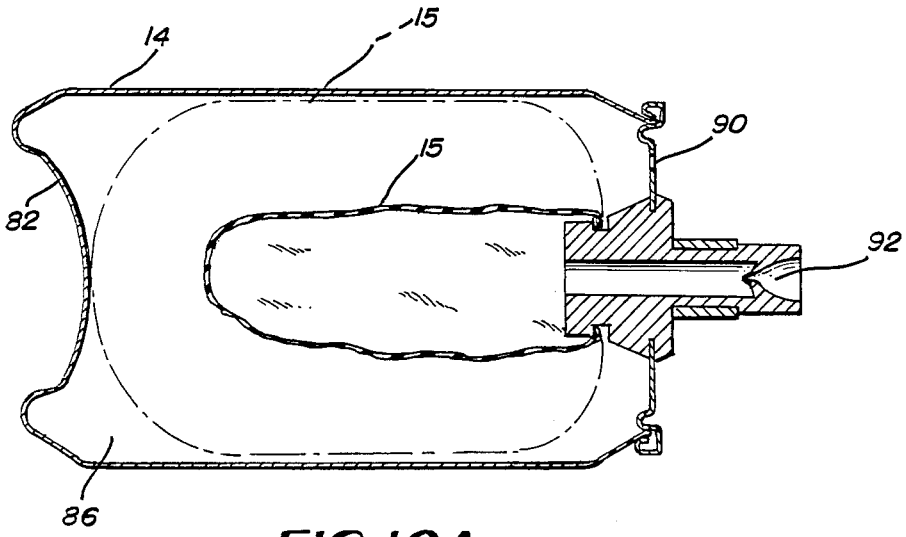
FIG. 10A is a cross-sectional view of a microgravity drinking cup having a drinking spout for use within the dispenser system of FIG. 1.

FIG. 10A is a cross-sectional view of a microgravity drinking cup having a drinking spout for use within the dispenser system of FIG. 1.

The microgravity drinking cup 14 shown in FIG. 10 is a somewhat more detailed view of the simple but efficient features used in the present invention. In particular, an additional vent hole 90 is provided in the upper surface of what may be a conventional can and lid. In the interior of the spout 80 is a duckbill valve 92.

Figure 10B:
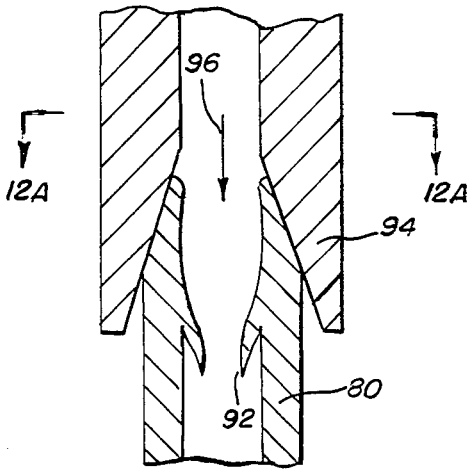
FIG. 10B is an enlarged view of the drinking spout of FIG. 10A engaged with a filler tube.

To fill the can 14, the filler tube 94 is placed in contact with the outside of the mouthpiece of drinking spout 80 as shown in FIG. 10B. If the internal angle of the filler tube 94 is shallow enough, a good seal will be obtained without requiring a large amount of downward force on the filler tube 94 against the drinking spout 80. As the product flows from the filler head through the filler tube 94 in the direction of arrow 96 through the duckbill valve 92, the fluid pressure forces the valve 92 open allowing the product to flow into and fill the expandable bladder 15. When the bladder is substantially full, as shown by the dashed lines in FIG. 10, the flow stops and the filler tube 94 can be removed The duckbill valve 92 prevents the product from flowing out of the can 14.

When the user wants to drink the product, he places the drinking spout 80 into his mouth and gently bites down on the end of the spout. This causes the duckbill valve to open. The bladder 15 will accordingly contract and force the product into the user's mouth. As soon as the user stops biting on the end of the mouthpiece o spout 80, the duckbill valve 92 closes, stopping the product flow. When the bladder 15 is empty, as shown by a solid line in FIG. 10, the cup 14 may be refilled.

Figure 11:
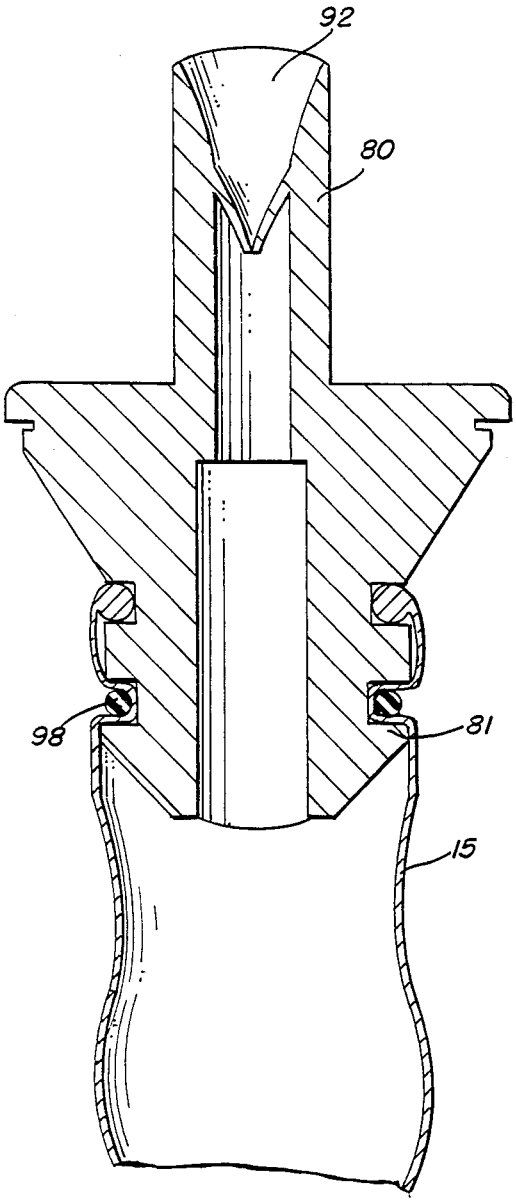
FIG. 11 is a cross-sectional view showing modifications of the drinking cup disclosed in FIG. 10.

FIG. 11 is a cross-sectional view showing modifications of the drinking cup 14 shown in FIG. 10, like reference numerals referring to like parts. Additionally shown in FIG. 11 is the use of an O-ring 98 to securely grip the bladder 15 within a recess 81 of the drink spout 80.

Figure 12A:
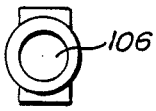
FIG. 12A shows a top view of a bite pad provided for use with the drinking spout of any microgravity drinking cup shown.
Figure 12B:
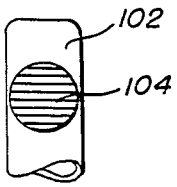
FIG. 12B is a front view of a bite pad provided for use with the drinking spout of any microgravity drinking cup shown.
Figure 12C:
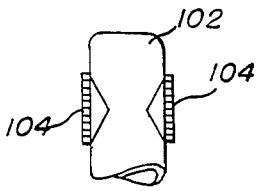
FIG. 12C is a side view of a bite pad provided for use with the drinking spout of any microgravity drinking cup shown.

Although the duckbill valve is ideally insensitive to orientation, bite pads may be provided as shown in FIGS. 12A–C. The bite pads are shown in a front, side, and top orientation. The top of the bite pad is generally shown at 106, the tooth-gripping portion is shown at 104 and the remaining bite Pad structure is generally shown at 102. The user can examine the bite locations to identify where the force of his bite is required to open the duckbill valve.

Figure 13A:
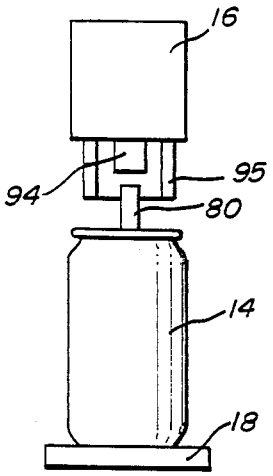
FIGS. 13A, 13B and 13C are front and side elevational views of the microgravity cup interfacing with the dispenser system of FIG. 1 prior to engagement with a filler head.
Figure 13B:
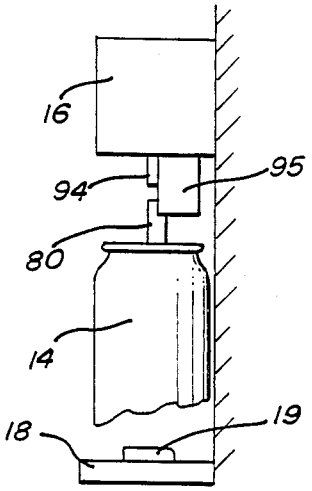
Figure 14A:
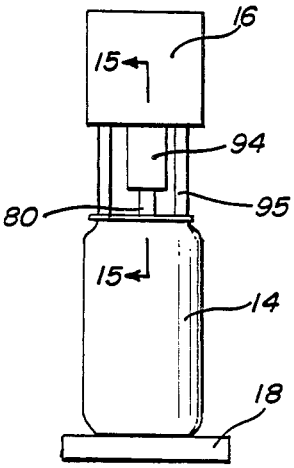
FIGS. 14A and 14B are a front and side elevational views of the microgravity cup interfacing with the dispenser system of FIG. 1 after engagement with the filler head.
Figure 14B:
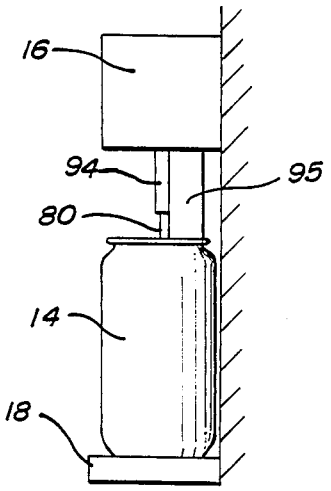
Figure 13C:
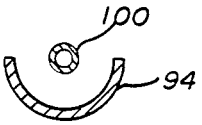
Figure 15:
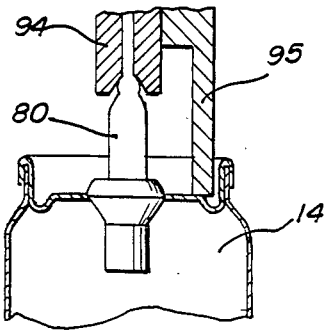
FIG. 15 is a partial cross-sectional view of the microgravity cup engaged with the filler head along line 16—16 of FIG. 14A.

FIGS. 13A and 13B are front and side elevational views of the microgravity cup 14 interfacing with the dispenser s prior to engagement with the filler head 16. FIGS. 14A, 14B are similar views after en of the cup 14 with the filler head 16. Figure a partial cross-sectional view taken along line B—B of FIG. 14.

There is additionally shown a cup hold-down device 95 depending from the filler head 16. The filler tube 94 is within the interior of the cup hold-down device 95. A cup locator 19 such as a magnet may be attached to the base of platform 18 for additionally holding the cup 14 in place on the platform if the cup is made of a metallic material such as a conventional can. In other words, he cup locator 19 initially holds the can 14 in place until the hold down device 95 secures the can in the filling position.

In operation, the user places the cup 14 onto the locator 19 of the platform 18. The user then presses the product selection button. Upon product selection, the filler head 16 having a cup hold-down device 95 descends to secure the cup in place. This prevents the user from removing the cup during a filling process. Alternatively, the filler head 16 and cup hold-down device 95 may be kept stationary while the platform 18 is raised.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A microgravity dispenser system for dispensing either a carbonated or still beverage in the microgravity conditions of outer space comprising:

a container for storing a supply of syrup;

a carbon dioxide source;

a water source for introducing either hot or cold water into said dispenser system;

a microgravity carbonator connected to at least said carbon dioxide source and the cold water source for maintaining a predetermined quantity of cold water at a predetermined level of carbonation;

a metering device for advancing predetermined proportions of both carbonated water and syrup within said dispenser system;

a microgravity drinking cup for receiving metered quantities of either said still or carbonated beverages; and means for filling said microgravity drinking cup with a beverage.

2. The microgravity dispenser system according to claim 1, further including a hold-down device beneath said means for filling, for stably positioning said microgravity drinking cup during filling thereof.

3. The microgravity dispenser system according to claim 1, wherein said microgravity carbonator includes a carbonation chamber, a floating piston reciprocable within said carbonation chamber, a water inlet provided in a first end of said chamber, a first carbon dioxide inlet provided adjacent said water inlet, vent means provided in an end of said chamber opposite to said water inlet, a second gas inlet positioned adjacent said vent means, and a carbonated water outlet positioned between said water inlet and said first carbon dioxide inlet for expelling carbonated water from said chamber.

4. The microgravity dispenser system according to claim 1, wherein said metering device includes a main piston cylinder housing, a main piston cylinder provided within said main piston cylinder housing, at least two channels axially formed within said main piston cylinder housing, said main piston cylinder being reciprocally engagable with said at least two channels to force predetermined quantities of syrup therethrough, means, formed in a first end of said main cylinder housing, for applying an axial pressure to an upper surface of said main piston cylinder, means for releasing said axial pressure from the upper surface of said main piston cylinder, carbonated water inlet means, formed at an opposing end of said main cylinder housing to said means for applying an axial pressure, for forcing carbonated water into said main cylinder housing, carbonated water outlet means, formed adjacent said carbonated water inlet means, for expelling carbonated water to the exterior of said main piston cylinder housing, and means for circulating syrup from at least two syrup supply tanks to corresponding one of said at least two channels, whereby a predetermined quantity of a selected syrup is metered with a predetermined quantity of carbonated water within said dispenser system.

5. The microgravity dispenser system according to claim 1, wherein said microgravity drinking cup includes a drinking cup having a rigid outer shell, an expandable bladder contained within said rigid outer shell, a disposable drinking spout attached to said bladder, and a vent opening formed in the base of said rigid outer shell.

6. The microgravity dispenser system according to claim 5, wherein said means for filling said microgravity drinking cup with a beverage further includes, means for pressurizing the interior of said rigid shell through said vent opening, a mixing chamber for mixing metered flows of syrup and carbonated water, a filler head, engagable with said disposable drinking spout, for repeatedly filling the bladder with a carbonated beverage, and means, responsive to said filler head filling the bladder with the carbonated beverage, for slowly depressurizing the interior of said rigid shell through said vent opening.

7. The microgravity dispenser system according to claim 6, wherein said means for pressurizing is air or carbon dioxide gas introduced to the interior of said rigid outer shell by a pressure relieving regulator.

8. The microgravity dispenser system according to claim 7, wherein said means for depressurizing is a vent to the atmosphere for releasing said air or carbon dioxide gas from the interior of said rigid outer shell at a controlled rate of flow.

9. The microgravity dispenser system according to claim 5, wherein said microgravity drinking cup is formed of a metal can having a metal lid and said disposable drinking spout is a conformable material having a duckbill valve formed therein.

* * * * *